United States Patent [19]

Osada

[11] Patent Number: 4,936,122

[45] Date of Patent: Jun. 26, 1990

[54] ELECTRONIC DOOR LOCK ASSEMBLY

[76] Inventor: Shunichi Osada, c/o Kokusan Kinzoku Kogyo Kabushiki Kaisha 8-2, Kamata 2-Chome, Ohta-ku, Tokyo, Japan

[21] Appl. No.: 132,239

[22] Filed: Dec. 14, 1987

Related U.S. Application Data

[63] Continuation-in-part of Ser. No. 741,166, Jun. 4, 1985, abandoned.

[51] Int. Cl.[5] ..... E05B 13/00

[52] U.S. Cl. ..... 70/214; 70/279; 70/283

[58] Field of Search ..... 70/214, 279, 280, 283, 70/285, 210, 213, 107, 467, 468, 471, 484, 485, 489, 277; 292/359

[56] References Cited

U.S. PATENT DOCUMENTS

| | | | |
|---|---|---|---|
| 1,496,909 | 6/1924 | Shapiro | 70/210 X |
| 2,034,997 | 3/1936 | Soper | 70/214 |
| 2,563,985 | 8/1951 | Yachzel | 70/467 X |
| 3,225,576 | 12/1965 | Richard | 70/277 |
| 3,769,822 | 11/1973 | Yulkowski | 70/107 |
| 3,881,331 | 5/1975 | Tranberg et al. | 70/107 |
| 3,967,846 | 7/1976 | Schlage | 292/359 |
| 4,073,518 | 2/1978 | Goodwin | 70/107 X |
| 4,148,092 | 4/1979 | Martin | 70/283 X |
| 4,274,272 | 6/1981 | Wang et al. | 70/214 |
| 4,426,864 | 1/1984 | Morikawa | 70/279 X |
| 4,509,347 | 4/1985 | Young | 70/280 X |

FOREIGN PATENT DOCUMENTS

| | | | |
|---|---|---|---|
| 696118 | 10/1964 | Canada | 70/277 |

*Primary Examiner*—Lloyd A. Gall

*Attorney, Agent, or Firm*—Fleit, Jacobson, Cohn, Price, Holman & Stern

[57] ABSTRACT

A door lock assembly comprises an outside operating section, an inside operating section and a mechanical lock, detachably mounted on a door. The outside operating section includes a switch button array which operates an electromagnetic plunger into an unlocking mode when a preselected number is set into switch buttons of the array. Operation of the electromagnetic plunger moves a mechanical on-off assembly to an off-position so that a rotatable knob can be manually rotated to operate a slidable dead bolt of the mechanical lock. The on-off assembly includes a resiliently biased slidable stop member mounted in a rotatably mounted member and having a reduced shoulder portion engageable in an opening in a cylindrical portion of a stationary hollow member, with the stop member being movable to an off-position disengaged from the opening by actuation of the electromagnetic plunger. The door lock assembly also includes a rotatable key lock for camming the stop member into its off-position, a latch bolt operating lever, an inside switch for energizing the electromagnetic plunger, and an inside operating knob and handle.

14 Claims, 7 Drawing Sheets

ELECTRONIC DOOR LOCK ASSEMBLY

This application is a continuation-in-part of application Ser. No. 741,166, filed June 4, 1985, now abandoned.

BACKGROUND OF THE INVENTION

1. Field of the Invention

This invention relates generally to improvements in and relating to electronic door lock assembly. More specifically, it relates to an electronic door lock assemblies for use on automotive vehicles.

2. Description of the Prior Art

Rather recently, such combined door locking and unlocking devices have been commercialized on the market, as comprising a conventional mechanical cylinder lock combined with an electronically controlled locking and unlocking mechanism. However, such conventional combined devices as above mentioned represent rather highly complicated structure, as a predominant drawback.

It is an object of the invention to provide an improved combined mechanical cylinder lock section with an electronically controlled locking and unlocking mechanism section of a highly simplified construction, by making these two sections to have as many as possible common elements, yet without loss of operational security and stability.

SUMMARY OF THE INVENTION

For the fulfillment of the above and further objects, the invention resides in a combined electronic and mechanical door lock assembly, comprising: an outside operating section, an inside operating section and a mechanical lock, all being detachably mounted on a closable and openable door, wherein the said outside operating section, comprises: a switch button array adapted for delivery of an energizing current in an unlocking sense upon correctly depressing sequentially the switch buttons of said array in correspondence to a specifically selected reference number; an electromagnetic plunger adapted for actuation by receiving supply of said energizing current derived from the said switch button array; a stationary hollow member; a mechanical on-off operation assembly including a member rotatably mounted on said stationary hollow member, said assembly being brought to its off-position by the actuation of the said electromagnetic plunger; and manually rotatable knob means mounted by said stationary member and adapted for being released from a mechanically locked stationary condition to a manually rotatable condition by release action of said mechanical on-off operation assembly when the latter is brought to its off-position; and said mechanical lock comprising a slidable dead bolt adapted for freeing said door for opening by turning manually said knob means upon positioning said mechanical on-off operation assembly to its off-position.

In the following, substantially a preferred embodiment of our invention will be described in detail with reference to the following accompanying drawings.

However, it should be noted that the invention is not limited to such embodiment only. To a person skilled in the art may easily occur any modification and improvement thereover, if occasion may occur. Therefore, the scope of the invention must be limited by the claims only which are appended hereto.

DESCRIPTION OF THE PREFERRED EMBODIMENTS

Referring now to the accompanying drawings, FIGS. 1–10, preferred embodiments will be illustrated more specifically.

In these drawings in combination, "A" represents an outside operating section; "B" an inside operating section; "C" a locking mechanism section; and "D" a door to which the inventive lock is applied.

Figure 1:
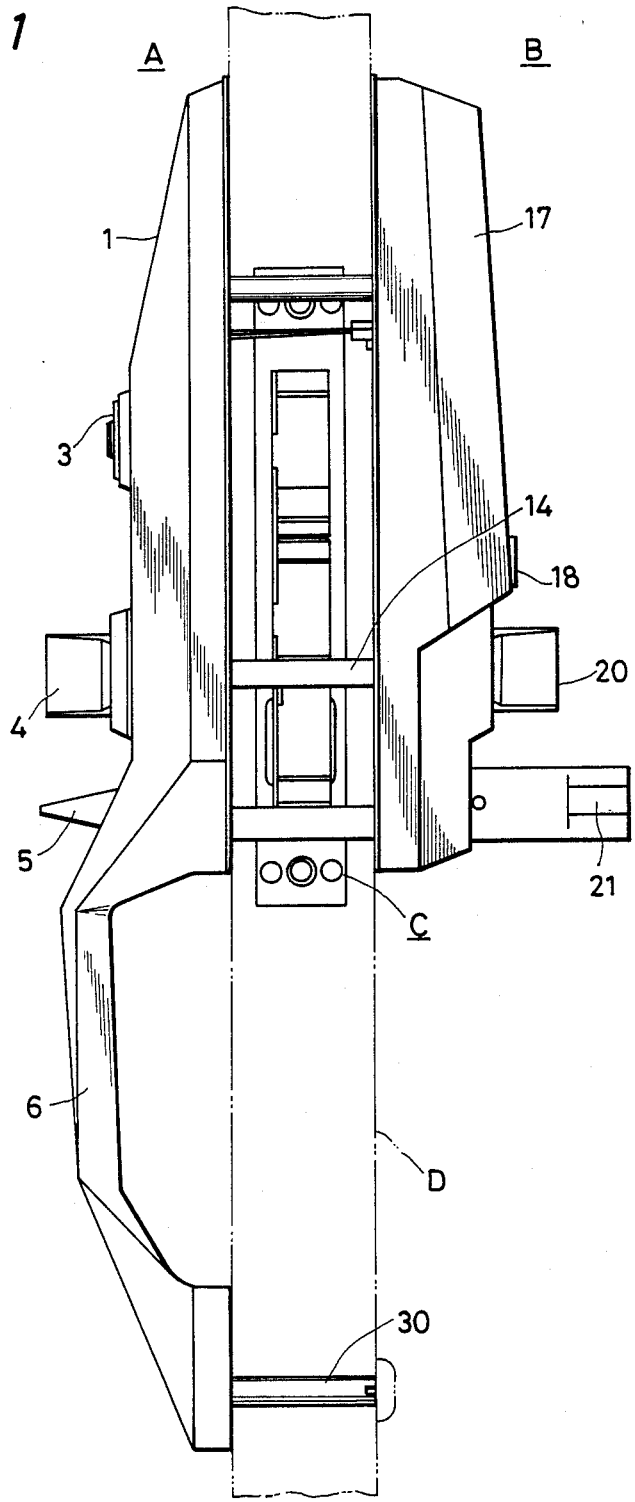
FIG. 1 is a front view of the combined mechanical and electronic door lock assembly according to the invention.
Figure 2:
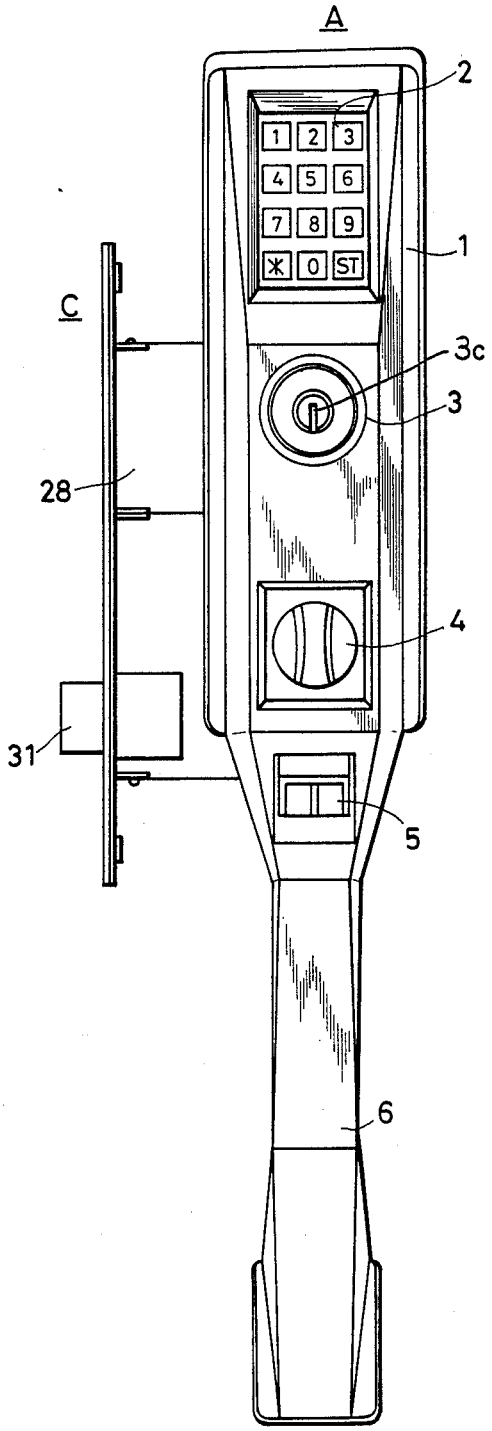
FIG. 2 is a front view of the outside operating section comprised in the said assembly.

The outside operating section "A" includes a member 1 having a portion with an inclined surface 1s (FIG. 4) on which an array of twelve, 3×4, push buttons "1", "2", "3", "4", "5", "6", "7", "8", "9", "*", "0" and "ST" are shown at 2, FIG. 2, the latter numeral 2 thus representing a switch board. Below this, there is a conventional key-operated cylinder lock 3, FIGS. 1, 2, 4 and 5. Still further below, there are provided a dead bolt-operating knob 4, FIGS. 1, 2, 4 and 6, a latch bolt-operating lever 5, FIGS. 1, 2, 4 and 5, and a handle section or hand grip 6, FIGS. 1, 2, 4 and 5, the latter constituting practically a continuation or extension of the casing 1. The rigid combination of casing 1 and handle section 6 is attached fixedly to the door "D" as at 30, FIGS. 1, 4 and 5. The door "D" is shown only partially and in its imaginary outline configuration by phantom, chain-dotted lines.

Figure 4:
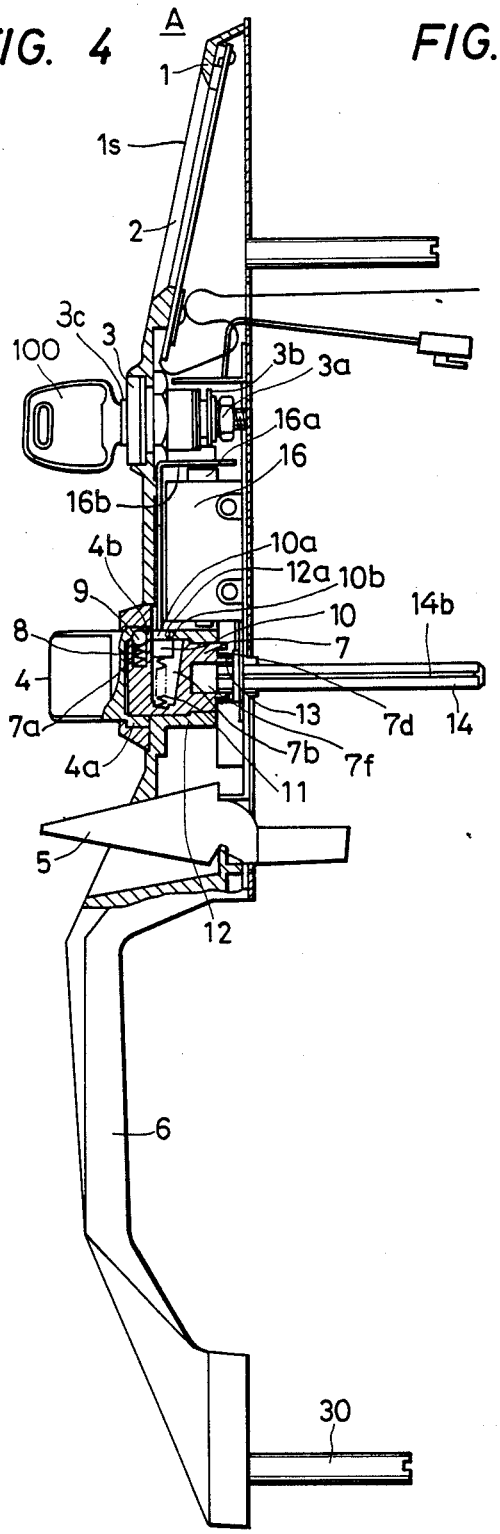
FIG. 4 is a longitudinal section of the outside operating section.
Figure 6:
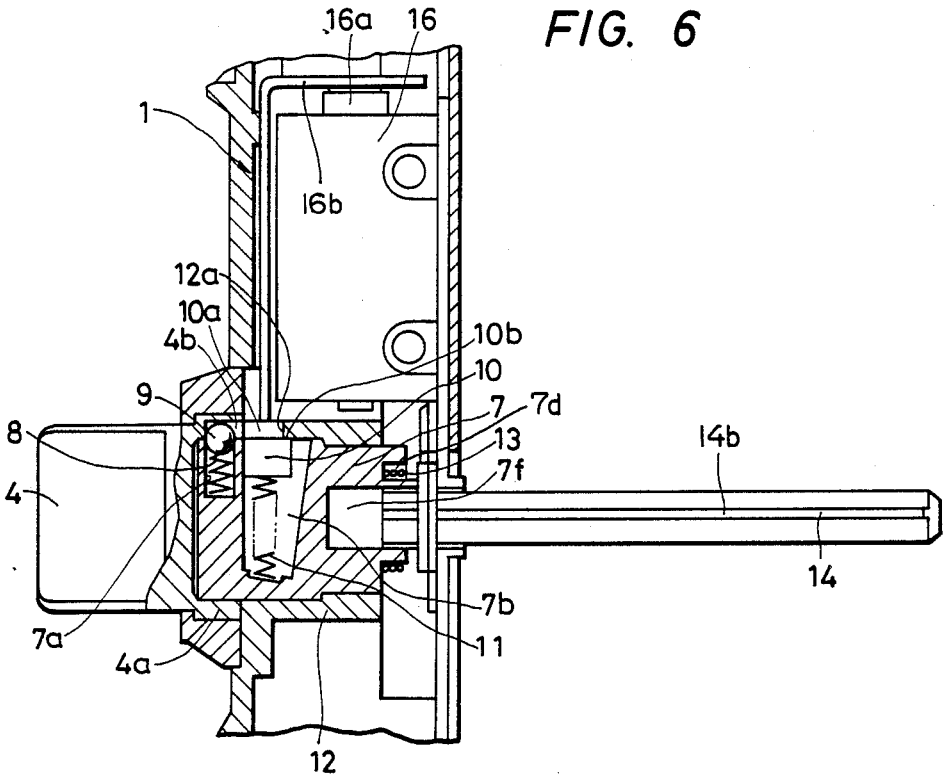
FIG. 6 is an enlarged view of a main part of the outside operating section shown in FIG. 4.
Figure 7A:
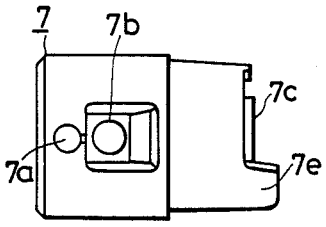
FIG. 7A, 7B and 7C are a plan view, a longitudinal section and a cross-section of a rotation regulator or -limiter employed in the inventive assembly.
Figure 7B:
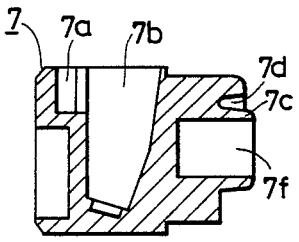
Figure 7C:
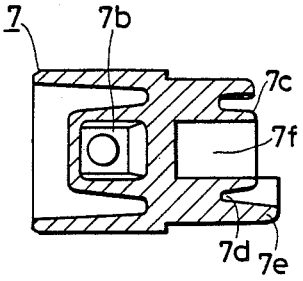

As seen from FIGS. 4 and 6, the knob 4 is made integral with a sleeve **4*a* which is concentrically and disengageably connected with a rotation limiter 7, FIGS. 4, 6 and 7, of a mechanical operation on-off assembly. The limiter 7 is formed with a lateral blind opening 7*a*, FIGS. 4, 6 and 7, near outer end of the limiter, a steel ball 9 being slidably mounted in the opening 7*a* and urged to move radially outwardly by an urging spring 8. With the ball 9 normally positioned as shown in FIGS. 4 and 6 and held in pressure contact with a downwardly opening receiving recess 4*b* formed on sleeve 4*a*, mechanical connection between knob 4 and limiter 7** is established and maintained, and thus these both are rotatable in unison.

A deep lateral well **7*b* formed in the limiter 7 receives a stop pin 10 which is urged to move outwardly by a backing coil spring 11**.

The limiter 7 is mounted rotatably in an inwardly projecting sleeve portion 12 made integral with casing 1. As is clearly shown in FIG. 4, when the head 10*a*, having a reduced shoulder 10*b*, of pin 10 is kept in engagement with a reception opening 12*a* formed through the wall of hollow cylindrical projection 12, the pin can not slip out from the opening 12*a*, on account of the shouldered surface contact between 10*b* and 12*a*.

A coil spring 13 serving as a return spring for the limiter 7 and having bent-up ends 13*a* and 13*b* is mounted in a ring recess 7*d* (best shown in FIGS. 7*b* and 7*c*) which is formed concentrically at the opposite end of limiter 7. At the opposite end of rotation limiter 7, there is a blind axial bore 7*f* which may be slightly tapered if desired, and the concentric ring recess 7*d*, a hollow cylindrical projection 7*c* being thus formed therebetween, as can most clearly be seen from FIG. 7. Since the outermost, cylindrical portion is formed to define the outer wall surface of the ring recess 7*d*, an arc-like projection 7*e* extends longitudinally and outwardly of the limiter 7.

Figure 5:
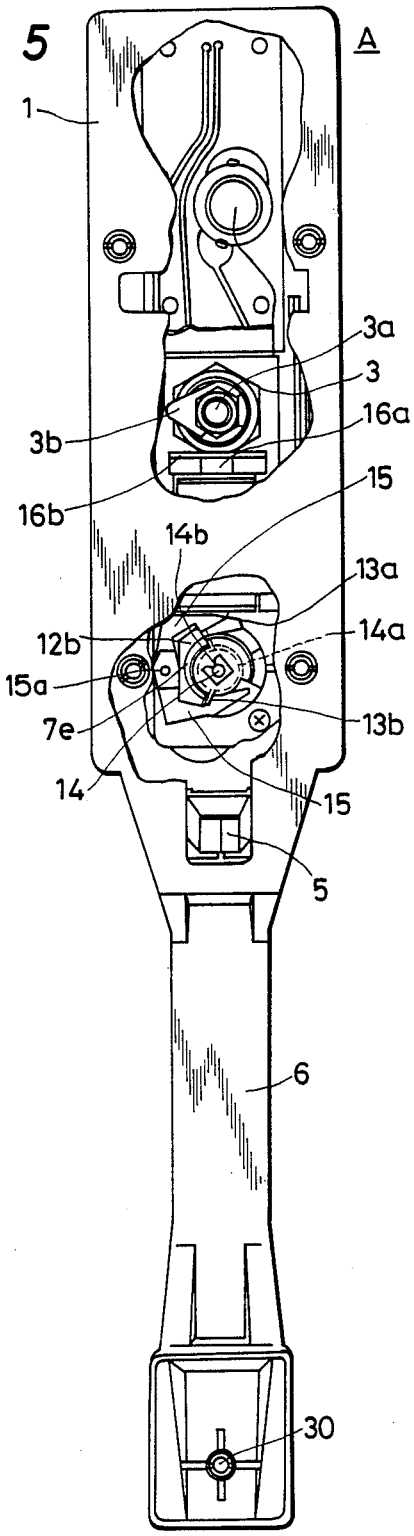
FIG. 5 is a rear view thereof.

As noted previously, numeral 13 denotes a coil spring inserted in the recess 7*d*, the said spring being formed with the bent-out, engageable end portions 13*a* and 13*b*, as shown in FIG. 5. These spring end portions are kept in pressure engagement with the projection 7*e*.

Corresponding to an substantially concentrically with the engageable projection 7*e*, a projection 12*b* is formed on the cylindrical portion 12, as shown in FIG. 5.

With this construction, it will be seen that the coil spring 13 acts effectively as a return spring for limiter 7.

Figure 10:
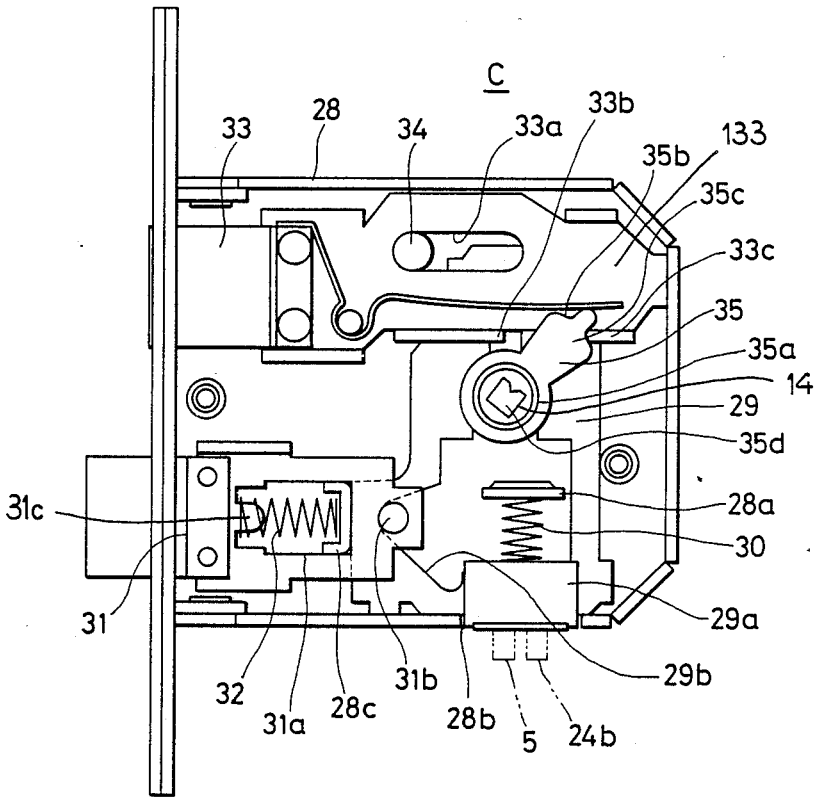
FIG. 10 is an outside view of a mechanical lock mechanism employed in the inventive assembly.

Numeral 14, FIGS. 4, 5 and 6, represents an operating rod for a conventional dead bolt 33 appearing at the upper part of FIG. 10, the said rod 14 having a substantially square cross-section as well as a longitudinal vee-groove 14*b* for better guidance thereof. The rod 14 is formed further with a substantially sector-shaped engageable lateral projection 14*a* (FIG. 5) for performing mechanical on-off contact with the said engageable projection 7*e* on limiter 7.

Numerals 15, FIG. 5, represent a pair of one-way ratchet-type lock plates which are pivotable at 15*a* and normally urged by a spring, not shown, toward 1 each other, so that hooks (not shown) of the lock plates engage in teeth (not shown) of the rod 14 in a known manner, for limiting the initial rotation of rod 14 in a clockwise direction only, as viewed in FIGS. 5 and 10.

If the concerned door D is positioned at the opposite side of the automotive vehicle, as an example, the initial rotation allowed for the rod 14 will be in the reverse direction.

A solenoid 16 having a movable plunger 16*a* is provided above the member 12, the said plunger cooperating with a drive piece 16*b* having a generally right-angle elevational configuration when seen in FIG. 4. The laterally extending, upper end of the drive piece 16*b* is attached to the top end of the plunger, while the lowermost end of the drive piece is kept in pressure contact with the pin 10. When the solenoid 16 is de-energized, the plunger is held at its upper position under the influence of the rotation-preventing pin 10 and through the drive piece 16*b*.

Figure 8:
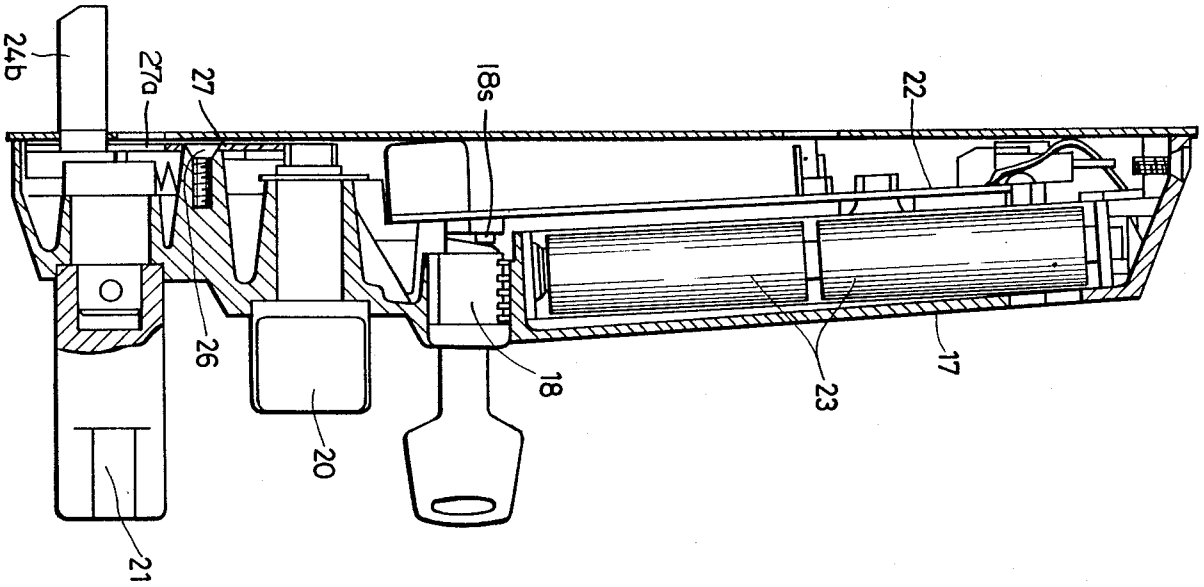
FIG. 8 is a longitudinal section of the inside operating section.

The solenoid 16 is energized by a battery 23 encased in the inside operation section B shown in FIG. 8, the electrical connection between the solenoid and battery having been omitted for avoiding excess complexity of the drawing.

When the solenoid 16 is energized from the battery 23, the plunger 16*a* is drawn downwards in FIGS. 4, 5 and 6 so that the drive element 16*b* will depress the pin 10 until the latter is disengaged from the reception opening 12*a* of the cylindrical portion 12.

At this position, the operator can rotate the rod 14 by turning manually the knob 4, FIGS. 1, 2, 3 and 6, for locking or unlocking the dead bolt 33 appearing at FIG. 10.

A conventional mechanical cylinder lock 3, FIGS. 1, 2, 4 and 5, is provided at a slightly lower level than the push button array 2 and directly above the solenoid 16 in FIG. 4.

When a mechanical key 100, FIG. 4, is inserted into a key hole 3*c*, FIG. 2, of the cylinder lock 3 and the operator turns the key, to rotate the rotor 3*a* having a sector-like cam 3*b* shown in FIGS. 4 and 5, the cam 3*b* depresses the drive member 16*b* together with plunger 16*a*. In this position, the operator can also rotate the dead bolt-operating rod 14 by manipulating the manual knob 4, as desired.

Figure 3:
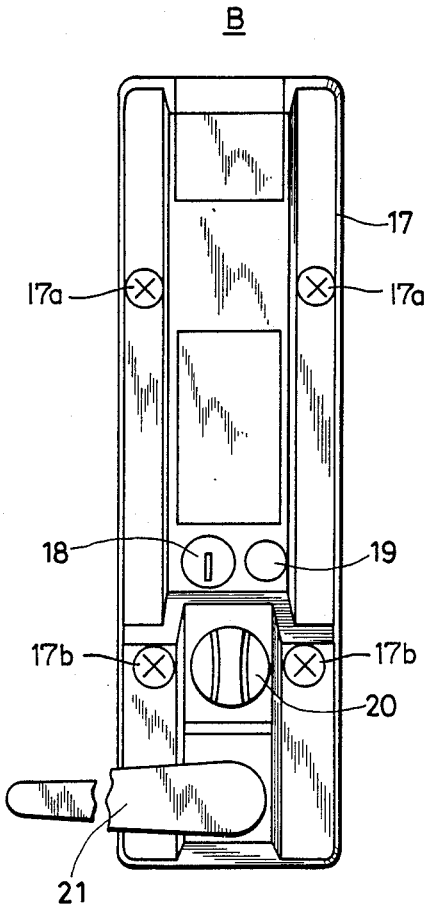
FIG. 3 is a front view of the inside operating section comprised in the said assembly.

At the inside operational section B, there is a casing 17 which is fixedly, yet detachably attached to the door D, at as 17*a* and 17*b* (best shown in FIG. 3). This casing 17 houses mechanical cylinder lock 18, one touch switch 19 and knob 20 provided with a handle 21. The cylinder lock 18 serves for on-off operation of a reset switch 183 (FIG. 8) for the code number. The switch 19 is adapted for operating the solenoid 16 from the inside of a vehicle without setting the code number. The knob 20 is used for the in-and-out operation of the dead bolt 33. The handle 21 is pivotable and used for the operation of the latch bolt 31 (FIGS. 2 and 10). As specifically shown in FIG. 8, the casing 17 mounts further therein electronic control circuit unit 22 as well as battery 23.

Figure 9:
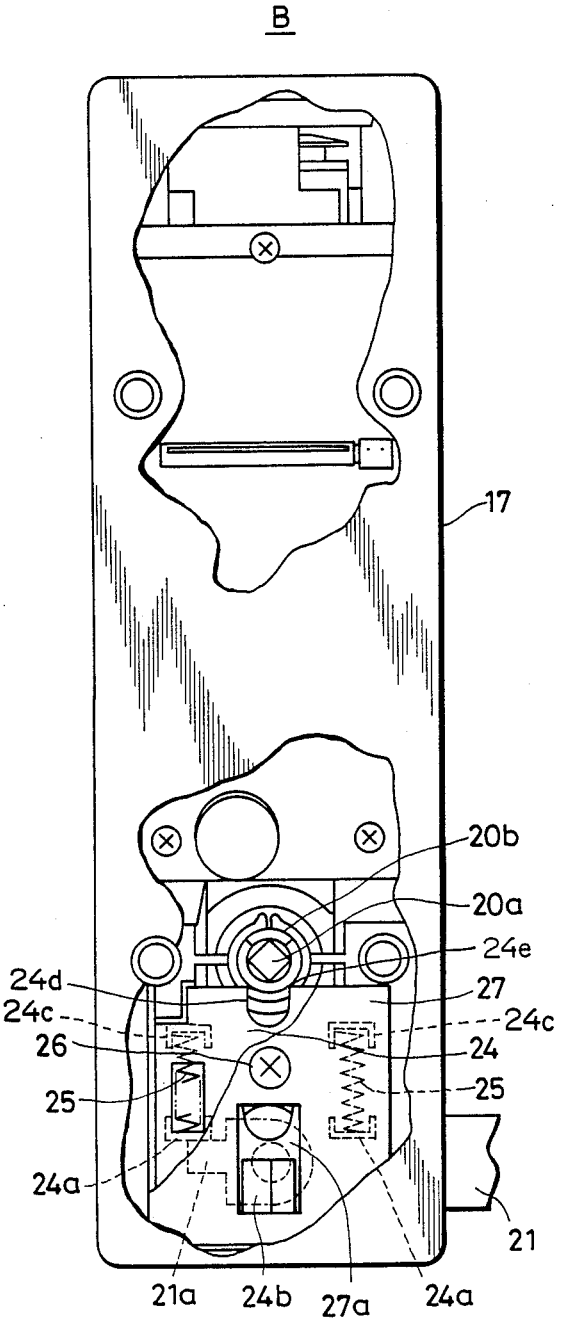
FIG. 9 is a rear view thereof.

At the inside end of the handle 21, a motion-transmitting member 21*a* appearing in FIG. 9 is mounted and kept in contact with a lower one of movable spring-mounting pieces 24*a* which are fixedly mounted on a slider plate 24, while other spring-mounting pieces 24*c* are mounted fixedly on the casing 17. The thus expandably and contractably mounted springs are denoted by numeral 25 as shown in FIG. 9. The slider plate 24 is thus elastically urged downwards in FIG. 9.

By manipulating the handle 21 to turn in one specifically designated direction, motion will be transmitted therefrom through drive member 21*a* to movable plate 24 in the upward direction. With release of the operator's hand from handle 21, the latter and the movable plate will automatically return to respective original positions under the urging action of coil springs 25.

The up-and-down movable plate 24 is provided with projecting latch bolt-operating member 24*b* which extends through and from a window opening 27*a* formed through guide plate 27 fixedly attached to a casing 17 by screw means as at 26.

Knob 20 is formed at its inner end portion with an axial square bore 20*a*, FIG. 9, receiving the related end portion of dead bolt-operating rod 14. As seen in the same FIG. 9, knob 20 is formed further with a motion-receiving axial projection 20*b* which is positioned in proximity of the upper end of the movable plate 24 when the dead bolt 33 is positioned at its locking service position.

When the handle 21 is rotated manually at this position to raise the plate 24, the knob 20 is rotated forcibly by cooperation of a semi-rounded opening 27*d* with said projection 20*b*, the dead bolt thereby 33 being instantly caused to rotate in the unlocking direction. More specifically, as viewed in FIG. 9, as the plate 24 is raised by rotation of the handle 21 a right-hand edge 24*e* of the semi-rounded opening 24*d* engages a right-hand portion of the projection 20*b* on the knob 20, causing the projection to rotate counter-clockwise into the semi-rounded opening. This unlocking mechanism 20 serves thus as a kind of emergency unlocking means.

Now referring to FIG. 10 showing the mechanical lock section C, numeral 28 represents a casing 28 in which a plate member 29 is mounted to be movable in the up-and-down direction in this figure. The plate 29 is fitted with a stop 29*a* for coil spring 30 which is held under compression between a stationary stop 28*a* on the casing and the said stop 29*a*, the plate 29 thereby being elastically urged to move downwardly in FIG. 10.

The stop or motion-receiving plate 29*a* has a free access from outside through an edge opening 28*b* of the casing 28. The plate 29 is adapted for cooperation with the latch bolt-operating lever 5 provided at the outside operational section A and the latch bolt operating piece 24*b* provided at the inside operational section B.

Latch bolt 31 is formed with an inside opening 31*a* in which engageable piece 28*a* is disposed. A coil spring 32 is held under compression between a stop 31*c* formed on latch bolt 31 and the said stop 28*c*, the latch bolt thereby being urged resiliently to move in the locking direction. The bolt 31 is provided nearly at its inner end with a pin 31*b* which is kept in contact with a tapered driving portion 29*b* formed on the movable plate 29. Therefore, when the plate 29 is caused to move in the rising direction, the bolt 31 will recede.

Dead bolt 33 is adapted for being guided in its locking advancement or unlocking receding motion by a longitudinal slot 33*a* formed therethrough and a stationary guide pin 34 formed on the casing 28. Case 28 mounts rotatably the functional end 35*a* of a dead bolt drive arm 35. The arm 35 is formed at its free end with engageable shoulders 35*b*; 35*c*. At an extension 133 of the bolt 33, as appearing in FIG. 10, is a pair of mutually separated motion-receiving shoulders 33*b*; 33*c*. Both of these shoulders are contacted alternately by the said shoulders 35*b*; 35*c* with rotational movement of the drive arm 35. Dead bolt 33 is thus caused to advance or recede, as the case may be, relative to the casing 28 for execution of door locking or unlocking service as desired and according to the rotational direction of drive arm 35. At the functional end 35*a* appearing in FIG. 10, there is formed a substantially square axial bore 35*d* which receives the functional end, appearing at FIG. 10, of the dead bolt operation bar 14.

Outside and inside operation sections A and B are fixed to the door D, and indeed, in opposition to each other and relative thereto, as is seen in FIG. 1. The mechanical lock section C is embedded completely within the interior of the door D, as is clearly understood from FIGS. 1 and 10.

Before describing the operation of the present inventive combined door locking and unlocking apparatus, it should be noted that a specifically selected reference number, for instance, "13568" as been stored at a certain electronic digital memory, not shown, of the electronic control circuit section 22, FIG. 8. When the operator manually manipulates the buttons of array 2 sequentially and correctly to signify the number "13568" that is in correspondence with the specific reference number, current will be supplied to solenoid 16, for instance, for several seconds, in the conventional manner as is highly well known to those skilled in the art. Thus, the plunger 16*a* is attracted and the rotation-preventing pin 10, FIG. 6, is depressed through driver element 16*b*, and rotation limiter 7 is made rotatable. At this position, when dead bolt operating knob 4 is manually rotated, the dead bolt 33 is brought into its door-locking or -unlocking position, as the case may be, in accordance with occasionally adopted rotational direction of the knob 4, while transmitting necessary motion to the dead bolt through the intermediary of operation bar 14.

Door locking or unlocking operation may be carried out from inside of the door D by manipulating the dead bolt operation knob 20. At the door locking position, the operator may press down the latch bolt operation handle 21 substantially instantly opening the door D in a one-tough operation.

In case of an operator's going out of the door, the inside one touch switch 19 is made on to energize the solenoid 16 door-locking state also can be brought about by manipulating the outside dead bolt operation knob 4, and indeed, without use of the button array 2, and thus, no reference number coincidence operation is required.

By manipulating the cylinder lock 3 with use of the mechanical key as at 100 from outside of the door D, plunger 16*a* of solenoid 16 is depressed by the action of cam 3*b*. In this manner, rotation-preventing pin 10 is driven by drive member 16*b* as before. Therefore, a door unlocking operation can be brought about in the same manner as before.

As a conclusion, merits of the present invention will be described only briefly.

The combined door-locking and unlocking assembly according to this invention comprises an outside operation section, an inside operation section and a mechanical lock mechanism. The outside operation section comprises a button array; a solenoid which is caused to operate upon manipulation of said button array so as to represent a specifically selected code number; a cylinder lock; and a dead bolt operation knob. A rotation limiter is arranged so as to cooperate with the dead bolt operation limiter which comprises a rotation-preventing pin, the latter being so designed and arranged when the solenoid is energized that a drive member connected with a plunger drives the said pin towards its unlocking position. A cam is attached to the rotor of the cylinder lock and the said cam may drive mechanically the solenoid plunger. On the other hand, the inside operation section comprises a dead bolt operating knob which is mechanically connected through intermediary of a dead bolt operation rod with said rotation limiter. By manual rotation of said dead bolt operation rod, the dead bolt provided at a mechanical locking mechanism is caused to be driven.

In this way, the combined door locking and unlocking can be brought into its unlocking position through the intermediary of the electromagnetic mechanism by specifying a specifically selected reference number by manipulation of the button array. Further, if desired, and with use of a mechanical key, the assembly can be brought into its unlocking position through part of the said electromagnetic mechanism. Either mechanical key-unlocking or keyless unlocking operation can be executed, and indeed, with use of a highly simplified mechanism in spite of the above mentioned executionability of the dual operational modes.

The embodiments of the invention in which an exclusive property or privilege is claimed are defined as follows:

1. In a combined electronic and mechanical door lock assembly, comprising: an outside operating section, an inside operating section and a mechanical lock, all being detachably mounted on a closable and openable door, the said outside operating section comprising:

a switch button array adapted for delivery of an energizing current in an unlocking sense upon correctly depressing sequentially the switch buttons of said array in correspondence to a specifically selected reference number;

an electromagnetic plunger adapted for actuation by receiving a supply of said energizing current derived from said switch button array;

a stationary hollow member;

a mechanical on-off operation assembly including a member rotatably mounted on said stationary hollow member; and manually rotatable knob means mounted by said stationary hollow member and adapted for being released from a mechanically locked stationary condition to a manually rotatable condition by release action of said mechanical on-off operation assembly when the latter is brought to an off-position, said stationary hollow member including a cylindrical portion having an opening therein, and said mechanical on-off operation assembly further including a resiliently biased slidable stop member mounted in said rotatably mounted member and having a portion engageable in the opening in said cylindrical portion to lock said knob means against turning, said stop member being movable into the off-position of said mechanical on-off operation assembly disengaged from the opening in said cylindrical portion by actuation of said electromagnetic plunger; and said mechanical lock comprising a slidable dead bolt adapted for freeing said door for opening by turning manually said knob means upon movement of said slidable stop member of said mechanical on-off operation assembly into its off-position.

2. The door lock assembly of claim 1, wherein said knob means includes a sleeve portion, said rotatably mounted member of said mechanical on-off operation assembly partially extends into said sleeve portion, and a resiliently biased member in said rotatably mounted member 3. The door lock assembly of claim 1, wherein a drive member operated by said electromagnetic plunger moves said resiliently biased slidable stop member into the off-position of said mechanical on-off operation assembly.

4. The door lock assembly of claim 3, which further comprises a rotatable key lock including a cam engageable with said drive member for moving the stop member into its off-position.

5. The door lock assembly of claim 4, wherein said drive member has an essentially right-angle configuration.

6. The door lock assembly of claim 5, wherein said knob means includes a sleeve portion, said rotatably mounted member of said mechanical on-off operation assembly partially extends into said sleeve portion, and a resiliently biased member in said rotatably mounted member interconnects said sleeve portion and said rotatably mounted member for rotation of said rotatably mounted member by said knob means.

7. The door lock assembly of claim 1, wherein said electromagnetic plunger also is operable by an inside switch of the inside operating section to bring said mechanical on-off operation assembly to the off-position.

8. A combined electronic-and-mechanical door lock assembly, comprising:

an outside operating section, an inside operating section and a mechanical lock, all being detachably mounted on a closable and openable door;

the said outside operating section comprising:

a casing having a first portion with an inclined surface, and an extension portion constituting a hand grip;

a switch button array adapted for delivery of an energizing current in an unlocking sense upon correctly depressing sequentially the switch buttons of said array in correspondence to a specifically selected reference code number, and mounted on said inclined surface of said first portion of said casing;

an electromagnetic plunger adapted for actuation by receiving a supply of the energizing current derived from said switch button array;

a stationary hollow member mounted in said casing; a mechanical on-off operation assembly including a member rotatably mounted on said stationary hollow member, said assembly being brought to an off-position by the actuation of said electromagnetic plunger; and manually rotatable knob means mounted by said stationary hollow member and adapted for being released from a mechanically locked stationary condition to a manually rotatable condition by the release action of said mechanical on-off operation assembly when the latter is brought to its off-position;

said mechanical lock comprising a slidable dead bolt adapted for freeing said door for opening by manually turning said knob means upon positioning said mechanical on-off operation assembly to its off-position;

said inside operating section comprising:

a casing attached to said door;

a mechanical cylinder lock for on-off operation of a reset switch for the code number;

a self-contained power source;

a switch adapted for use to energize said electromagnetic plunger without setting the code number in said switch button array;

a knob for in-and-out operation of said dead bolt; and a handle for in-and-out operation of said dead bolt.

9. The door lock assembly of claim 8, wherein said stationary hollow member of said outside operating section includes a cylindrical portion having an opening therein, and said mechanical on-off operation assembly further includes a resiliently biased slidable stop member mounted in said rotatably mounted member and having a portion engageable in the opening in said cylindrical portion to lock said knob means against turning, said stop member being movable into an off-position disengaged from the opening in said cylindrical portion by actuation of said electromagnetic plunger.

10. The door lock assembly of claim 9, wherein said knob means includes a sleeve portion, said rotatably mounted member of said mechanical on-off operation assembly partially extends into said sleeve portion, and a resiliently biased member in said rotatably mounted member interconnects said sleeve portion and said rotatably mounted member for rotation of said rotatably mounted member by said knob means.

11. The door lock assembly of claim 9, wherein a drive member operated by said electromagnetic plunger moves said resiliently biased slidable stop member into its off-position.

12. The door lock assembly of claim 11, which further comprises a rotatable key lock including a cam engageable with said drive member for moving the stop member into its off-position.

13. The door lock assembly of claim 12, wherein said drive member has an essentially right-angle configuration.

14. The door lock assembly of claim 13, wherein said knob means includes a sleeve portion, said rotatably mounted member of said mechanical on-off operation assembly partially extends into said sleeve portion, and a resiliently biased member in said rotatably mounted member interconnects said sleeve portion and said rotatably mounted member for rotation of said rotatably mounted member by said knob means.

* * * * *